United States Patent [19]

Burns

[11] Patent Number: 4,646,488

[45] Date of Patent: Mar. 3, 1987

[54] RAIN DISPERSER SYSTEM

[76] Inventor: Lawrence C. Burns, 751 Riversville Rd., Greenwich, Conn. 06830

[21] Appl. No.: 794,505

[22] Filed: Nov. 4, 1985

[51] Int. Cl.[4] ..... E04D 13/00

[52] U.S. Cl. ..... 52/94; 52/12; 52/97; 52/660; 52/669

[58] Field of Search ..... 52/12, 24, 78, 473, 52/660, 669, 94, 97

[56] References Cited

U.S. PATENT DOCUMENTS

| | | | |
|---|---|---|---|
| 2,708,775 | 5/1955 | Maas | 52/78 |
| 2,842,811 | 7/1958 | Weeks | 52/473 |
| 2,905,286 | 9/1959 | Adams et al. | 52/669 X |
| 3,033,086 | 5/1962 | Marsden | 52/660 X |
| 3,228,152 | 1/1966 | Wilbourn | 52/78 |
| 3,662,503 | 5/1972 | Praisler | 52/97 |
| 3,755,988 | 9/1973 | Van Der Sluys | 52/473 |
| 3,939,616 | 2/1976 | Schapker | 52/94 |
| 4,068,424 | 1/1978 | Madfis | 52/97 X |

*Primary Examiner*—Alfred C. Perham

*Attorney, Agent, or Firm*—F. Eugene Davis, IV; Mark P. Stone

[57] ABSTRACT

The present invention provides an improved rain disperser system of the type in which an assembly includes a plurality of longitudinally extending plate-like members and a plurality of transversely mounted spacer members for maintaining the plate-like members a predetermined distance apart. The assembly is mounted proximate to the edge of a roof by a suitable bracket. The spaced apart, plate-like member assembly disperses rain water flowing down a roof into fine droplets, thus avoiding the need to install roof gutters and, at the same time, preventing corrosive damage to the ground below by otherwise unimpeded run-off water. In accordance with the present invention, a new spacer element is provided for the disperser system which includes tab-like members integrally extending from the body of the spacer element for mounting the spacer elements to the plate-like members. The tabs may be inserted through openings in the plate-like members and orbitally riveted thereto. In the alternative, the tabs may be folded to provide a peening surface and the spacers may be mounted to the plate-like members on such peening surface.

17 Claims, 7 Drawing Figures

RAIN DISPERSER SYSTEM

BACKGROUND ART

The present invention is an improvement to the rain disperser system disclosed in U.S. Pat. No. 3, 939,616 entitled 'Rain Water Run-Off Disperser" issued on Feb. 24, 1976, to Richard L. Schapker. The disclosure of the patent is hereby expressly incorporated by reference in the present application.

U.S. Pat. No. 3,939,616 discloses a novel system for dispersing run-off rain water from a roof. This system effectively eliminates the need to install conventional rain gutters. As discussed in the patent, rain gutters are generally expensive to install, and leaves or other waste material are susceptible to accumulate in conventional rain gutters. However, the failure to provide rain gutters or otherwise control run-off water from a roof will have a damaging and corrosive effect on the terrain below the roof as a result of the high velocity and repetive impact of unimpeded run-off water. The system disclosed in U.S. Pat. No. 3,393,616 provides an assembly which eliminates the need for conventional rain gutters yet avoids the harmful effect of unimpeded run-off water on the terrain directly below the roof.

The preferred embodiment of the invention disclosed by the aforementioned patent is illustrated in FIG. 9 thereof. The rain disperser assembly includes a plurality of plate-like members extending in a longitudinal direction (parallel to the edge of the roof) and are maintained in a predetermined spaced apart parallel relationship, at a predetermined angle relative to the horizontal, by a plurality of transversely oriented spacer elements. The assembly including the plate-like members and transverse spacers is mounted proximate to the edge of a roof by suitable bracket means. The spacer elements include a plurality of inclined surfaces adapted to support a corresponding number of parallel plate-like members at a predetermined angle. The plate-like members are mounted to the inclined surfaces of the spacer elements by bonding, by resistance or ultrasonic welding means, or other means such as epoxy, as is more fully disclosed in the discussion of FIG. 10 of the patent. However, in practice, it has been found that the spacer elements disclosed in the patent, and the means for bonding them to the plate-like members, have not been totally effective.

It is an object of the present invention to provide an improved spacer element which assures that the spacer element will be securely and permanently mounted to the assembly to maintain the plate-like members in their permanent spaced apart parallel relationship.

DISCLOSURE OF THE INVENTION

The object of the present invention is to provide an improved rain disperser system of the type including a plurality of spaced apart, parallel plate-like members maintained in a predetermined fixed relationship by a plurality of transverse spacer members. Each spacer member defines a plurality of parallel inclined surfaces for supporting a different plate-like member at a predetermined angle. The number of inclined surfaces defined on each spacer member corresponds to at least the number of parallel plate-like members included in the rain disperser assembly. Each inclined surface on the spacer member defines an integral tab-like member extending upwardly from the inclined surface and substantially normal thereto. These tab-like members are provided for securely mounting the spacer members to the plate-like members for permanently assembling the overall rain disperser assembly. In the preferred embodiment of the invention, suitable openings are defined in each of the plate-like members and the tab-like members on the spacers are inserted through these openings. The portions of the tab extending through the plate-like member may be orbitally riveted to the upper surface of the plate-like member. In the alternative, the tabs may be folded and peened to the plate-like members either at their upper or lower surfaces. In all instances, the tab-like members provided on the inclined surfaces of the spacer elements enable the spacers to be permanently and securely affixed to the longitudinally extending platelike members to provide a more effective rain disperser assembly.

BEST MODE FOR CARRYING OUT THE INVENTION

Figure 4:
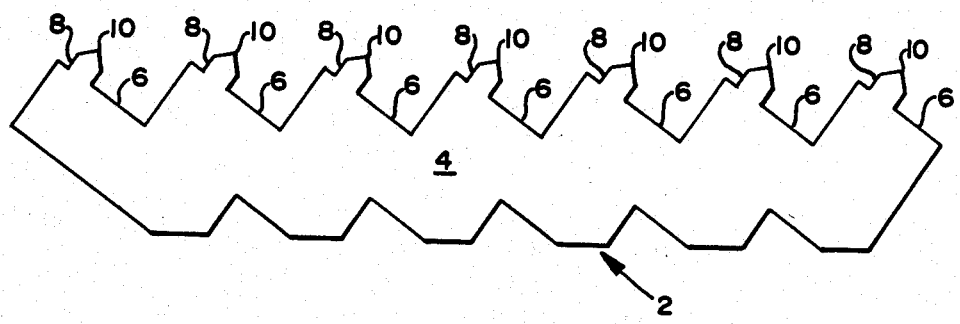
FIG. 4 is a side elevational view of the new spacer element of FIG. 3.
Figure 3:
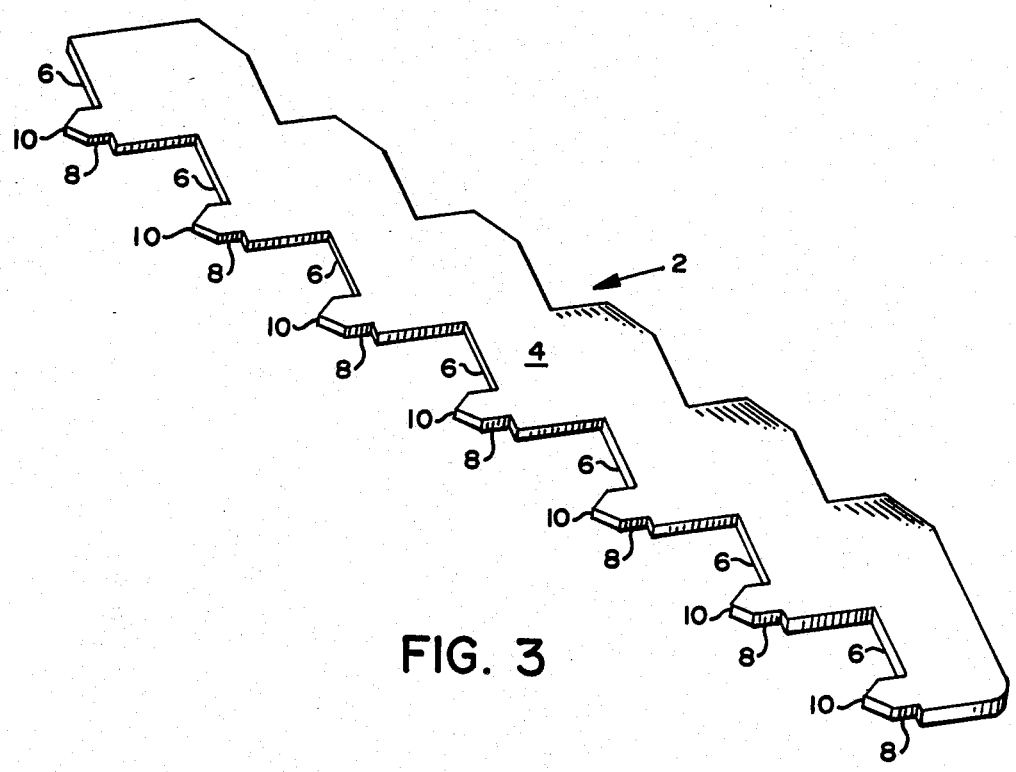
FIG. 3 is a perspective view of a new spacer for the rain disperser system in accordance with the present invention.

Referring first to FIGS. 3 and 4 of the drawing, an improved spacer element for a rain disperser system is disclosed. The spacer element, referred to generally as reference number 2, includes a body portion or base 4 integrally defining a plurality of inclined surfaces 6. These inclined surfaces are oriented at an angle of approximately 45° degrees with respect to the horizontal. Each of the inclined surfaces defines a tab 8 integrally extending from the inclined surface at an angle substantially normal thereto. The tabs are located proximate to the upper portion of each inclined surface, and terminate in a generally pointlike or arrowhead-type configuration as designated by the reference numeral 10.

Figure 1:
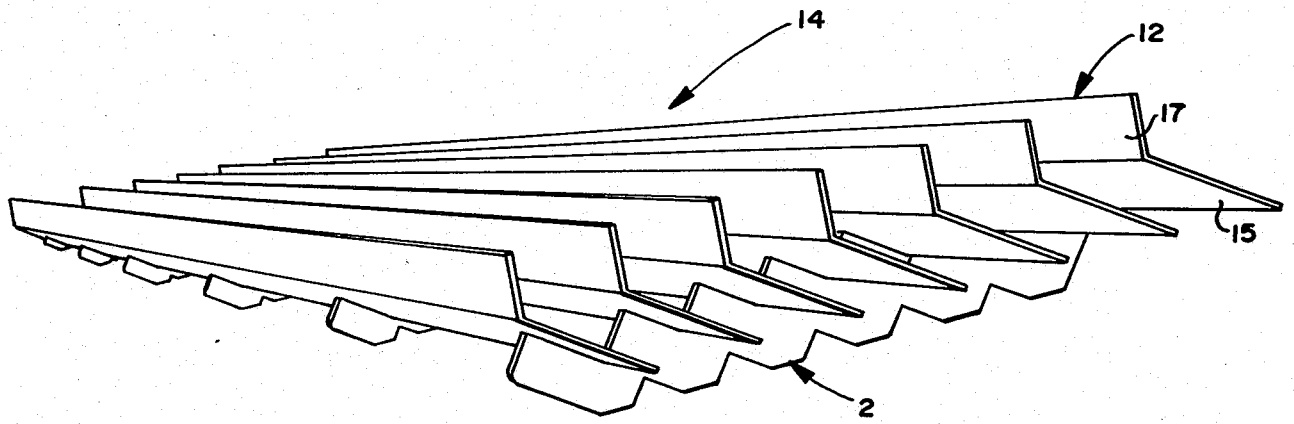
FIG. 1 is a perspective view of a rain disperser system incorporating the new spacer element of the present invention.
Figure 2:
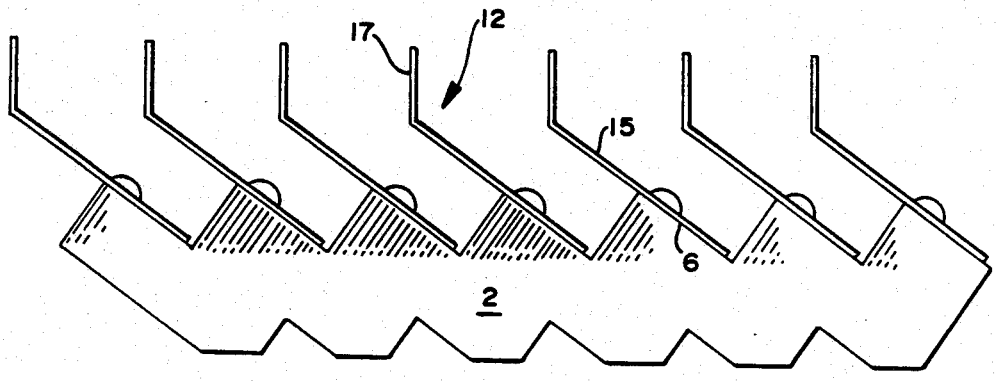
FIG. 2 is a side elevational view of the new rain disperser system of FIG. 1.

Referring now to FIGS. 1 and 2, the spacer element 2 is shown in its operative position in a rain disperser assembly including a plurality of longitudinally extending, parallel plate-like members or slats 12. In the embodiment disclosed by these drawing figures, the rain disperser assembly, designated generally by the reference numeral 14, includes seven plate-like members or slats arranged in an inclined parallel relationship. Each slat includes a lower segment 15 which is received on an inclined surface 6 of a spacer member 2, and an upper segment 17 extending upwardly and at an angle from the lower segment 15. A plurality of spacer members 2 are oriented transversely to the parallel slats 12. As noted above, each of the spacer members defines a plurality of inclined surfaces corresponding in number to the number of slats in the rain disperser assembly. In the disclosed embodiment of the invention, the assembly includes seven parallel slats and each spacer member thus defines seven separate parallel inclined surfaces. The lower portion 15 of each slat 12 is received on and supported by one of the inclined surfaces 6 of the spacer member 2. Preferably the inclined surfaces of the spacer members are oriented on an angle of approximately 45° degrees with respect to the horizontal so that the slats will also be oriented at this angle.

Figure 5:
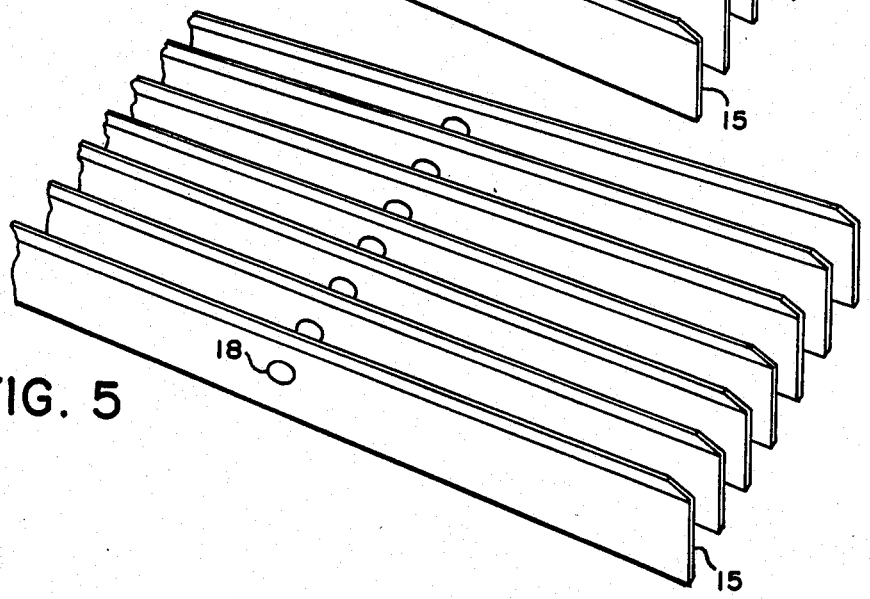
FIG. 5 is a fragmented perspective view illustrating a first manner for mounting the transverse spacer elements to the system.

In the preferred embodiment of the invention, the spacer members are orbitally riveted to each of the slats by the tabs 8 defined on the spacers. More specifically, each of the slats is provided with an opening which is sufficiently large to receive one tab 8 of the spacer element therethrough. Preferably, the thickness of the slats is approximately 32 mils while the tabs extending from the inclined surfaces of the spacer members are approximately 80 mils in length. Accordingly, when the tab of the spacer member is inserted through the opening in the slat, a portion of the tab extends through the opposed side of the slat. The extended portion of the tab is orbitally riveted to the surface of the opposed side of the slat through which the tab extends. FIGS. 2 and 5 of the drawings illustrate the assembly after the tabs have been orbitally riveted to the slats.

The concept of orbital riveting is known to the art and will not be explained in detail herein. The basic concept as applied to the present invention is that a huge compression force is applied to the portion of the tab extending through the slat. This compressive force deforms the extended tab portion into a circular member or rivet (reference numeral 18 of FIG. 5) which is forced against the opposed surface of the slat. The diameter of the deformed rivet-shaped extension is larger than the opening in the slat, thereby preventing the deformed tab from slipping back through the opening in the slat. The deformation of the extension and the compression thereof against the opposed surface of the slat firmly retains the spacer member affixed to the slat. Because the tab is integral with the body of the spacer member itself, the strength and security of the assembled disperser system is enhanced.

Orbital riveting of the integral tabs to the slats is performed for each of the tabs on each of the spacers forming the assembly. The result is that all slats are firmly and permanently secured to their respective inclined surfaces on each of the spacer members.

For further information regarding the general concept of orbitally riveting and apparatus used in orbital riveting, attention is directed to a publication entitled "Spir-O-Matic Orbital Fastening" by VSI Automation of Troy, Mich. The text of this publication is incorporated herein by reference.

Figure 6:
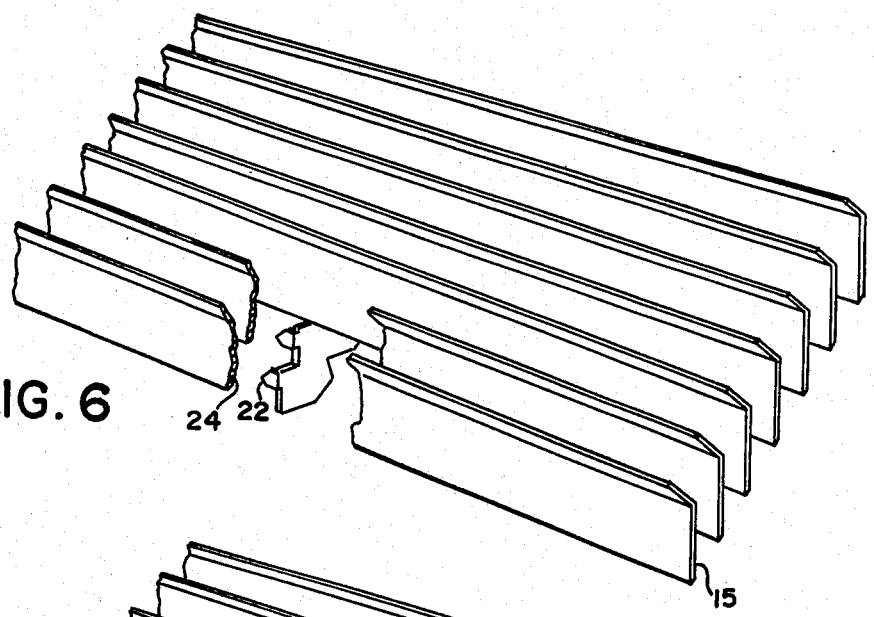
FIG. 6 is a fragmented perspective view of a second embodiment of the invention showing a different manner for mounting the spacer elements to the system.
Figure 7:
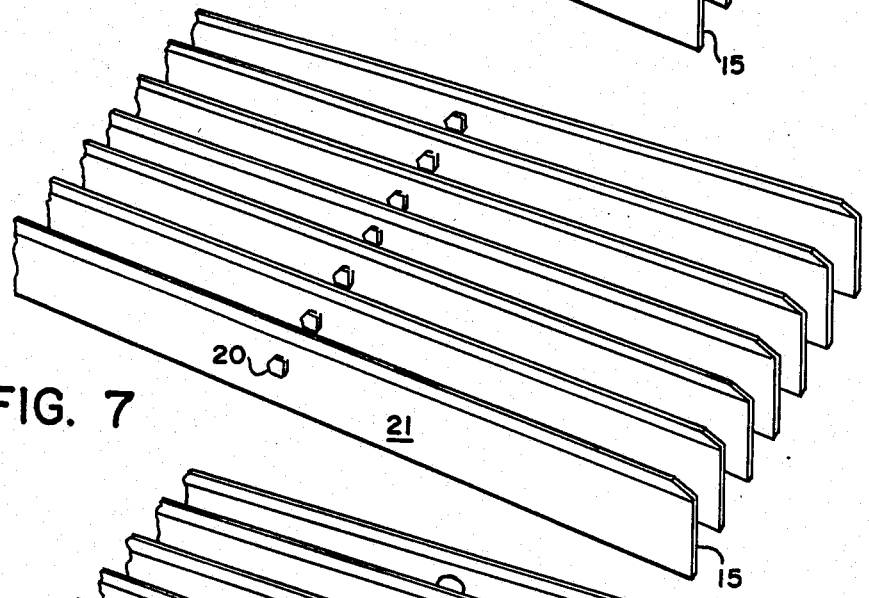
FIG. 7 is another fragmented perspective view of a third embodiment of the invention showing a further different manner for mounting the spacer elements to the assembly.

In alternative embodiments of the invention as illustrated by FIGS. 6 and 7, the tab-like members 8 integrally extending from the inclined surfaces 6 of the transverse spacer members 2 may be used to assemble the rain disperser assembly in several different manners. For example, as shown in FIG. 7, the tabs may be peened to the opposed surfaces of the slats in a manner similar to orbital riveting described above. In this embodiment, the tabs 8 are inserted through suitable openings (not shown) in the slats but instead of being orbitally riveted to the opposed surface of the slats, the tabs are folded at an angle of 90° degrees against the outer surface of the slats as shown by reference numeral 20 on FIG. 7. The folded portions of the tabs are affixed to the outer surface 21 of the lower segment 15 of the slats by any suitable means, as for example bonding, welding or soldering. The folded portion 20 of the tab is larger than the opening in the slat to firmly secure the tab to the slat.

In a similar manner as shown in FIG. 6, providing openings on the slats may be avoided completely by folding the tabs of the spacer member at an angle of about 90° degrees and welding or soldering the folded surfaces 22 of the tabs to the inner surface 24 of the slats. However, this embodiment of the invention is less preferred than those previously described because the integrity of the assembly is enhanced when the tabs are actually inserted through openings in the slats and affixed to the outer slat surfaces.

It is evident that the new configuration for a spacer member for a rain disperser assembly as described herein, including tab-like extensions integrally defined on the inclined surfaces of the spacer member, provides a variety of ways to securely mount the slats of the assembly firmly and securely to the supporting spacer members in a predetermined permanent relationship. The tabs may be orbitally riveted to the slats after the tabs have been inserted through openings provided in the slats, or the tabs may be folded to provide a peening surface for mounting the spacer members to either side of the slats. In any of the embodiments discussed herein, a rain disperser assembly using the new configuration of spacer members provides a more efficient overall assembly because the tab surfaces advantageously provide a relatively large surface area for mounting the slats.

In the preferred embodiments of the invention, the slats, spacers and brackets are formed from aluminum. However, other materials, such as other metals or even durable plastics, may suitably be used in place of aluminum.

The discussion of the preferred embodiments of the invention herein is intended to be illustrative only, and not restrictive of the scope of the invention, that scope being defined in the following claims and all equivalents thereto.

I claim:

1. In a rain disperser system of the type including a plurality of longitudinally extending parallel slats and at least one spacer element mounted to said slats and oriented substantially transversely thereto for maintaining said slats in parallel relationship spaced a predetermined distance apart from each other, the improvement comprising:

said spacer element including a body defining a plurality of inclined surfaces, the number of said inclined surfaces being at least equal to the number of slats, a tab extending from each of said inclined surfaces for mounting said spacer element to said slats, each of said slats defining an opening therein and said tabs being inserted through the respective openings in said slats for mounting said spacer element to said slats.

2. The system as claimed in claim 1 wherein said portion of said tabs extending through said openings in said slats are orbitally riveted to said slats for mounting said spacer element thereto.

3. In a rain disperser system of the type including a plurality of longitudinally extending parallel slats and at least one spacer element mounted to said slats and oriented substantially transversely thereto for maintaining said slats in parallel relationship spaced a predetermined distance apart from each other, the improvement comprising:

said spacer element including a body defining a plurality of inclined surfaces, the number of said inclined surfaces being at least equal to the number of slats, and each of said slats comprising a first longitudinal portion which is mounted to a different one of said inclined surfaces and each of said slats having a second portion extending integrally at an angle from said first portion and being oriented in a direction away from said inclined surface to which said first portion is mounted.

4. In a rain disperser system of the type including a plurality of longitudinally extending parallel slats and at least one spacer element mounted to said slats and oriented substantially transversely thereto for maintaining said slats in parallel relationship spaced a predetermined distance apart from each other, the improvement comprising:

said spacer element including a body defining a plurality of inclined surfaces, the number of said inclined surfaces being at least equal to the number of slats, and a tab extending from each of said inclined surfaces for mounting said spacer element to said slats.

5. The system of claim 4 wherein said tabs extending from said inclined surfaces are integrally defined on said inclined surfaces.

6. The system of claim 4 wherein said tabs terminate in a point.

7. The system as claimed in claim 4 wherein said tabs are welded to said slats.

8. The system as claimed in claim 4 wherein said tabs are soldered to said slats.

9. The system as claimed in claim 4 wherein said tabs are mounted to said slats by folding said tabs against said slats.

10. A method of assembling a rain dispenser system of the type including a plurality of longitudinally extending slats arranged in parallel relationship to each other, and at least one transversely oriented spacer element mounted to said slats for maintaining said slats at a predetermined spacing apart from each other, said method including:

providing a spacer element having a plurality of inclined surfaces and a tab member extending from each of said inclined surfaces, mounting each of said tab members to a different one of said slats for forming said rain disperser system.

11. The method of claim 10 including the step of welding said tabs to said slats.

12. The method of claim 10 including the step of soldering said tabs to said slats.

13. The method of claim 10 wherein each tab is peened to a different one of said plurality of slats..

14. The method of claim 10 including the steps of folding said tabs and mounting said folded portions of said tabs to said respective slats.

15. The method of claim 14 wherein each tab is folded approximately 90°.

16. A method of assembling a rain disperser system of the type including a plurality of longitudinally extending slats arranged in parallel relationship to each other, and at least one transversely oriented spacer element mounted to said slats for maintaining said slats at a predetermined spacing apart from each other, said method including:

providing a spacer element having a plurality of inclined surfaces and a tab member extending from each of said inclined surfaces;

providing an opening in each of said slats; inserting said tabs of the spacer element through the respective openings provided in said slats; and orbitally riveting the portion of each tab extending through each slat to its respective slat for mounting each of said tab members to a different one of said slats for forming said rain disperser system.

17. A method of assembling a rain disperser system to the type including a plurality of longitudinally extending slats arranged in parallel relationship to each other, and at least one transversely oriented spacer element mounted to said slats for maintaining said slats at a predetermined spacing apart from each other, said method including:

providing a spacer element having a plurality of inclined surfaces and a tab member extending from each of said inclined surfaces, and mounting each of said tab members to a different one of said slats for forming said rain disperser system by:

providing an opening in each of said plurality of slats;

inserting said tabs through the respective openings in said slats; and folding the portions of the tabs extending through each opening against the respective slat for mounting said tabs to said slats.

* * * * *